US009610695B2

(12) United States Patent
Obermann et al.

(10) Patent No.: US 9,610,695 B2
(45) Date of Patent: Apr. 4, 2017

(54) HAIR-CLIPPING DEVICE AND CUTTER-MEMBER ASSEMBLY FOR SUCH A DEVICE

(75) Inventors: Wolfgang Obermann, Klagenfurt (AT); Michael Janny, Klagenfurt (AT)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 2143 days.

(21) Appl. No.: 11/722,685

(22) PCT Filed: Dec. 19, 2005

(86) PCT No.: PCT/IB2005/054317

§ 371 (c)(1),
(2), (4) Date: Dec. 5, 2008

(87) PCT Pub. No.: WO2006/072851

PCT Pub. Date: Jul. 13, 2006

(65) Prior Publication Data

US 2011/0094110 A1 Apr. 28, 2011

(30) Foreign Application Priority Data

Jan. 3, 2005 (EP) ..... 05100011

(51) Int. Cl.

| | |
|---|---|
| ***B26B 19/04*** | (2006.01) |
| ***B26B 19/38*** | (2006.01) |
| *B26B 21/40* | (2006.01) |

(52) U.S. Cl.

CPC ..... *B26B 19/042* (2013.01); *B26B 19/38* (2013.01); *B26B 21/4018* (2013.01)

(58) Field of Classification Search

CPC ..... B26B 19/14; B26B 19/042; B26B 19/384; B26B 19/04; B26B 19/42; B26B 19/141; B26B 19/143; B26B 21/4018

(Continued)

(56) References Cited

U.S. PATENT DOCUMENTS

| | | | | |
|---|---|---|---|---|
| 2,037,957 | A | 4/1936 | Andis | |
| 2,083,579 | A * | 6/1937 | Schmitt | 30/34.2 |

(Continued)

FOREIGN PATENT DOCUMENTS

| | | |
|---|---|---|
| JP | 58037871 U | 3/1983 |
| JP | 61244390 A | 10/1986 |

(Continued)

*Primary Examiner* — Laura M Lee

(57) ABSTRACT

A hair-clipping device comprises a stationary cutter member (2; 52; 102; 152; 202; 252; 302; 352), at least one movable cutter member (7; 57; 407; 457), and a drive (9, 14, 15; 465) coupled to the movable cutter member (7; 57; 407; 457) for driving movement of the movable cutter member (7; 57; 407; 457). The stationary cutter member (2; 52; 102; 152; 202; 252; 302; 352) has an outer surface (3; 53; 103), a chamber (4) bounded by an inner surface (5) and at least one hair-catching opening (6; 56; 406) extending from the outer surface (3; 53; 103) to the inner surface (5). The movable cutter member (7; 57; 407; 457) comprises at least one cutting edge (8), fits in the chamber (4) with a free, close fit and includes a continuous carrier (15; 465) oriented in longitudinal direction of the movable cutter member (7; 57; 407; 457). The cutting edges (8) are provided on cutters (16) projecting radially from the carrier (15; 465). A set of cutter members for such a hair-clipping device is also described.

13 Claims, 8 Drawing Sheets

(58) Field of Classification Search
USPC ..... 30/34.2, 43.92, 346.51
See application file for complete search history.

(56) References Cited

U.S. PATENT DOCUMENTS

| | | | | | |
|---|---|---|---|---|---|
| 2,091,338 | A | * | 8/1937 | Segal | 30/34.2 |
| 2,098,849 | A | | 11/1937 | Amsler | |
| 2,119,248 | A | * | 5/1938 | Segal | 30/34.2 |
| 2,161,981 | A | | 6/1939 | Ruskin | |
| 2,178,669 | A | | 11/1939 | Lougheed | |
| 2,204,146 | A | * | 6/1940 | Muros | 30/43.92 |
| 2,223,294 | A | | 11/1940 | Muros | |
| 2,253,737 | A | | 8/1941 | Testi | |
| 2,265,281 | A | | 12/1941 | Hale | |
| 2,337,623 | A | * | 12/1943 | Romao | 30/34.2 |
| 2,564,379 | A | | 8/1951 | Smith | |
| 2,574,316 | A | * | 11/1951 | Berg | 30/43.2 |
| 2,661,532 | A | * | 12/1953 | Max Salz | B26B 19/12 30/346.51 |
| 3,827,144 | A | * | 8/1974 | Arpino | 30/43.92 |
| 3,863,338 | A | | 2/1975 | Wellinger | |
| 4,031,618 | A | | 6/1977 | Mansfield | |
| 4,139,940 | A | * | 2/1979 | Buras et al. | 30/43.92 |
| 4,700,476 | A | | 10/1987 | Locke | |
| 5,131,147 | A | * | 7/1992 | Plevyak | B26B 19/04 30/346.51 |
| 5,709,698 | A | | 1/1998 | Adams | |
| 6,151,780 | A | | 11/2000 | Klein | |
| 6,638,289 | B1 | | 10/2003 | Johnson | |
| 2003/0191487 | A1 | | 10/2003 | Robison | |
| 2005/0223559 | A1 | * | 10/2005 | Stevens | 30/34.2 |

FOREIGN PATENT DOCUMENTS

| | | | |
|---|---|---|---|
| JP | S6137419 | * | 10/1986 |
| JP | 63203178 | A | 8/1988 |
| JP | 2000300861 | A | 10/2000 |
| NL | 53896 | | 2/1943 |
| NL | 8502836 | A | 5/1987 |

* cited by examiner

HAIR-CLIPPING DEVICE AND CUTTER-MEMBER ASSEMBLY FOR SUCH A DEVICE

The invention relates to a hair-clipping device for shaving or trimming hair. The invention also relates to a cutter member assembly for a hair-clipping device. From U.S. Pat. No. 2,178,669, a hair-clipping device is known, which includes a stationary cutter member, a movable cutter member and a drive coupled to the movable cutter member. The stationary cutter member has an outer surface, a chamber bounded by an inner surface parallel to the outer surface, hair-catching openings extending from the outer surface to the inner surface. The movable cutter member has at least one cutting edge and fits in the chamber with a free, close fit. The drive is coupled to the movable cutter member for driving movement of the movable cutter member relative to the stationary cutter member. In this hair-clipping device, the movable cutter member is in the form of a coiled wire that has been ground on the outside for obtaining the free, close fit. According to this document, the free fit can be so close, that no friction-adding pressure between the elements is necessary to insure clean cutting, which greatly reduces power demand. The flexibility of the helix is described to take care of any possible lack of straightness in the chamber.

However, disadvantages of helical cutter members are that manufacturing and handling is relatively complex and that axial loads cause helical bodies to deform in radial sense as well.

It is an object of the invention to provide a hair-clipping device in which the movable cutter member is easier to manufacture, while the free, close fit of the movable cutter member in the chamber is reliably insured.

According to the present invention, this object is achieved by providing a hair-clipping device including a stationary cutter member, a movable cutter member including a carrier oriented in a longitudinal direction and a plurality of alternating gaps and cutters projecting radially from the carrier and a drive coupled to the movable cutter member for driving the movable cutter member relative to the stationary cutter member.

Because the or each movable cutter member includes a carrier extending in longitudinal direction, along at least a number of the cutters of the movable cutter member, and the cutting edges are provided on the cutters projecting radially from the carrier, the cutter member can be manufactured to tight tolerances easily and is radially stiff, so that maintenance of the close, free fit in operation is reliably ensured. The movable cutter member accommodates to non-straightness of the chamber relatively easily, because the longitudinally oriented carrier from which the cutters project towards the inner surface bounding the chamber has a cross-section that is considerably smaller than the cross-section of the chamber.

The invention may also be embodied in a cutter-member assembly including a stationary cutter member and a movable cutter member including a carrier oriented in a longitudinal direction and a plurality of alternating gaps and cutters projecting radially from the carrier each having at least one cutting edge, which is specifically adapted for use as part of a hair clipping device according to the invention. Particular embodiments of the invention are set forth in the dependent claims.

Further aspects, effects and details of the invention are set forth in the detailed description with reference to examples of which some are shown in the schematic drawings.

Figure 1:
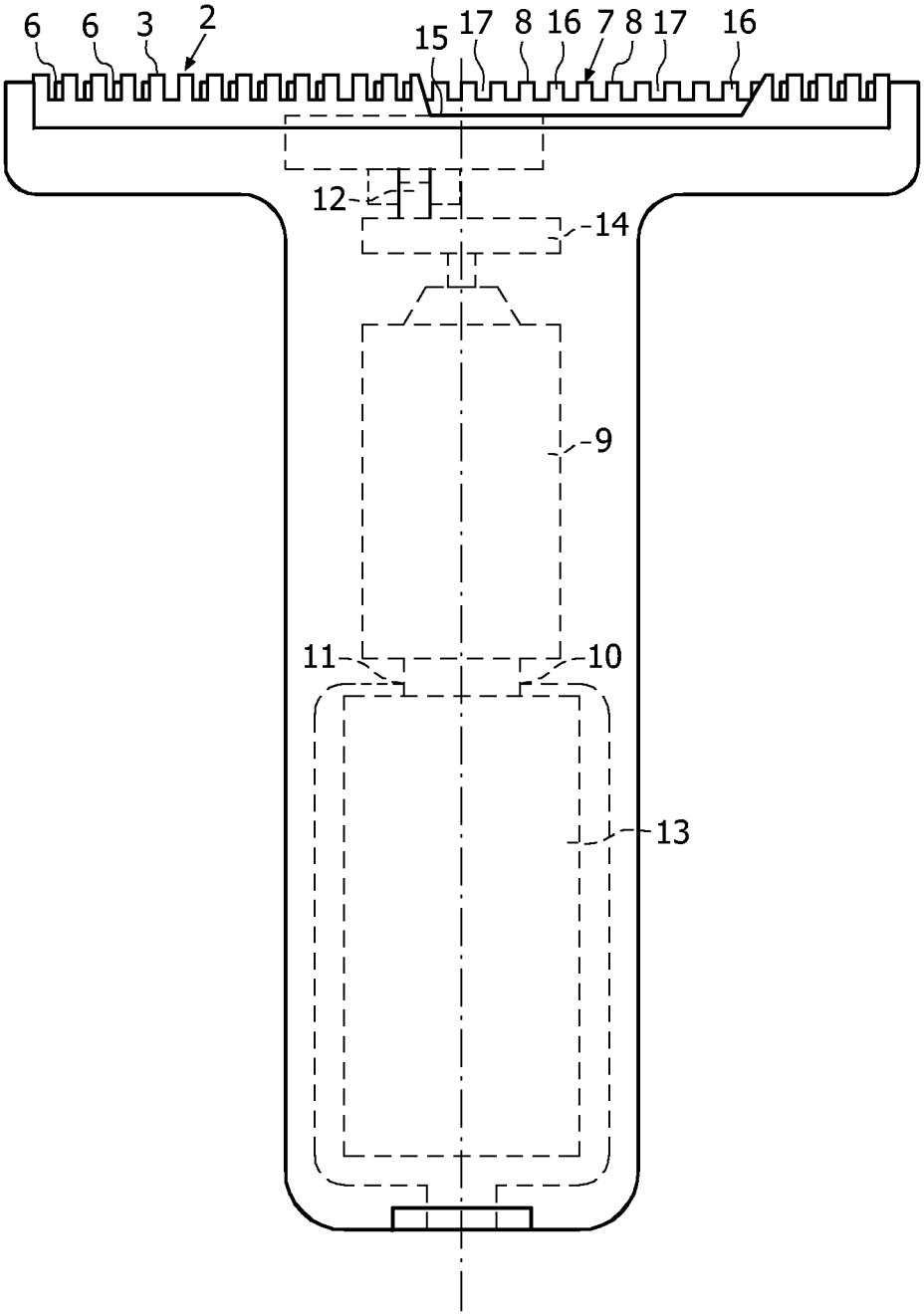
FIG. 1 is a partially cut-away representation of an example of a hair-clipping device according to the invention.
Figure 3:
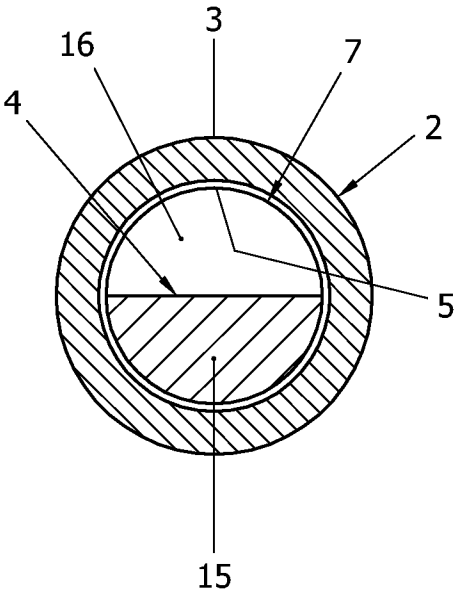
FIG. 3 is an enlarged cross-sectional view along a the line II-II in FIG. 2.
Figure 2:
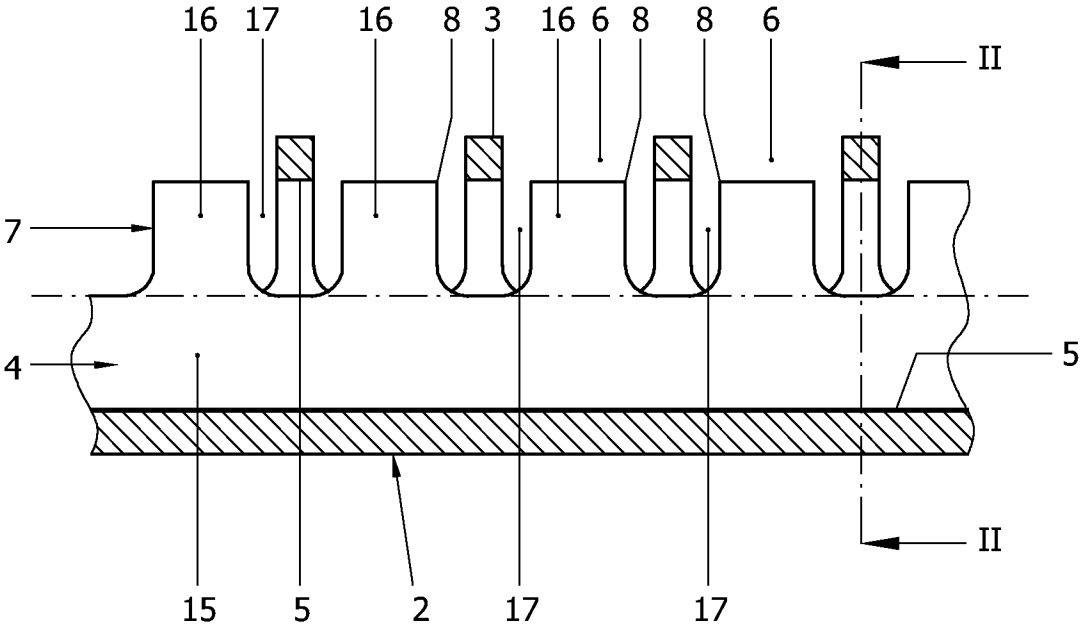
FIG. 2 is an enlarged cross-sectional view along a plane in longitudinal direction of the cutter members of portions of the stationary and movable cutter members.

In FIGS. 1-3 an example of a hair-clipping device according to the invention is shown. The hair-clipping device according to this example can be used both as a shaver for close shaving and as a trimmer for cutting and, as far as desired, shaving hair along the boundaries of for instance a beard, a moustache, side-whiskers or eye-brows or along the bikini line. In the shown hair-clipping devices, several parts, such as cutting edges, occur in large numbers. For the sake of clarity, in several instances, not all corresponding parts in the drawings are designated by reference numerals.

The hair-clipping device has a housing 1 carrying at one of its ends a stationary cutter member 2. The stationary cutter member 2 has an outer surface 3 for contacting a skin to be shaved and a hole (chamber) 4 bounded by an inner surface 5 parallel to the outer surface 3. The hole is profile-shaped.

Although in the present example the outer surface is designed for shaving the skin to be shaved smoothly, the outer surface may also be designed and positioned for contacting the skin to be shaved in such a manner that, during the shaving, the hairs are cut off at a predetermined, or at least controlled length, such as when using a hair-clipper.

Hair-catching openings 6 extend from the outer surface 3 to the inner surface 5 and are arranged in a row in longitudinal direction of the stationary cutter member 2. A movable cutter member 7 fits in the hole 4 with a free, close fit and has a row of cutting edges 8, the row being oriented in the same direction as the row of hair-catching openings 6 and as the movable cutting member 7. A drive composed of an electric motor 9 connected via conductors 10, 11 to a battery 13, an excenter disk 14 and a slot 12 in which a knob of the excenter disk 14 is engaged is coupled to the movable cutter member 7 for driving movement of the movable cutter member 7 relative to the stationary cutter member 2. The free fit of the movable cutting member 7 in the hole 4 helps to avoid radial pressure caused by pre-stress, such as occurs for example when a movable cutter member is resiliently pressed against a stationary cutter member by spring force. Accordingly, additional normal pressure and associated friction added by tightness between the hole 4 and the movable cutting member are also avoided. The close fit insures reliable cutting of hairs that are caught between the cutter members 2, 7.

The movable cutter member 7 includes a continuous carrier 15 oriented in longitudinal direction of the movable cutter member 7. The cutting edges 8 are provided on cutters 16 projecting radially from the carrier 15. The cutter member 7 can be manufactured to tight tolerances easily and is radially stiff in the sense that dynamic and static loads that are exerted onto the movable cutter member 7 during use cause very little changes in the radial dimensions of the cutter member 7. For instance, all longitudinal loads, such as loads caused by oscillating movement, friction forces and shear forces exerted onto the hairs during cutting, cause very little deformation of the axially extending carrier 15 which is very stiff longitudinally. The cutters 16 each only have to transfer loads that are directly exerted thereon and are not involved in the transfer of loads exerted by or onto other ones of the cutters 16 and the loads that are exerted onto the cutters 16 during use have only minimal effect on the dimensions of the cutters 16 in radial directions. Thus, maintenance of the close, free fit in operation is reliably ensured. Nevertheless, non-straightness of the hole 4, which may for instance be caused by manufacturing tolerances or by loads exerted onto the stationary cutter member 2 during shaving, causes only relatively small loads to exerted by the hole 4 onto the movable cutter member 7 and, accordingly, relatively little friction between the movable cutter member 7 and the inner surface 5 of the hole 4, because the longitudinally oriented carrier 15 from which the cutters 16 project towards the inner surface 5 bounding the hole 4 have a cross-section that is considerably smaller than the cross-section of the hole 4 and therefore bends relatively easily in planes in its longitudinal direction.

According to the present example, the movable cutter member 7 includes a rod section with recesses 17 and the carrier 15 is formed by a portion of the rod that is continuous in longitudinal direction of the cutter member 7. The rod section is preferably solid for large axial stiffness by small bending stiffness, as in this example, but may also be hollow. The cutting edges 8 are integrally formed with the carrier 15 by edges of the recesses 17 in the rod. Thus, the movable cutter member 7 can be manufactured in a simple manner and with tight tolerances, for example by cylindrical grinding and grinding the recesses in the rod. Furthermore, the integral construction reduces the risk of damage due to failure of connections between the carrier 15 and the cutters 16.

Although in the present example the carrier 15 is continuous in longitudinal direction over the length or almost the length of the stationary cutter member 2 as well, it is also possible to provide two or more movable cutter members each continuos along the cutters of its own carrier. The plurality of movable cutter members may be separately movable and may also be separately drivable.

Figure 13:
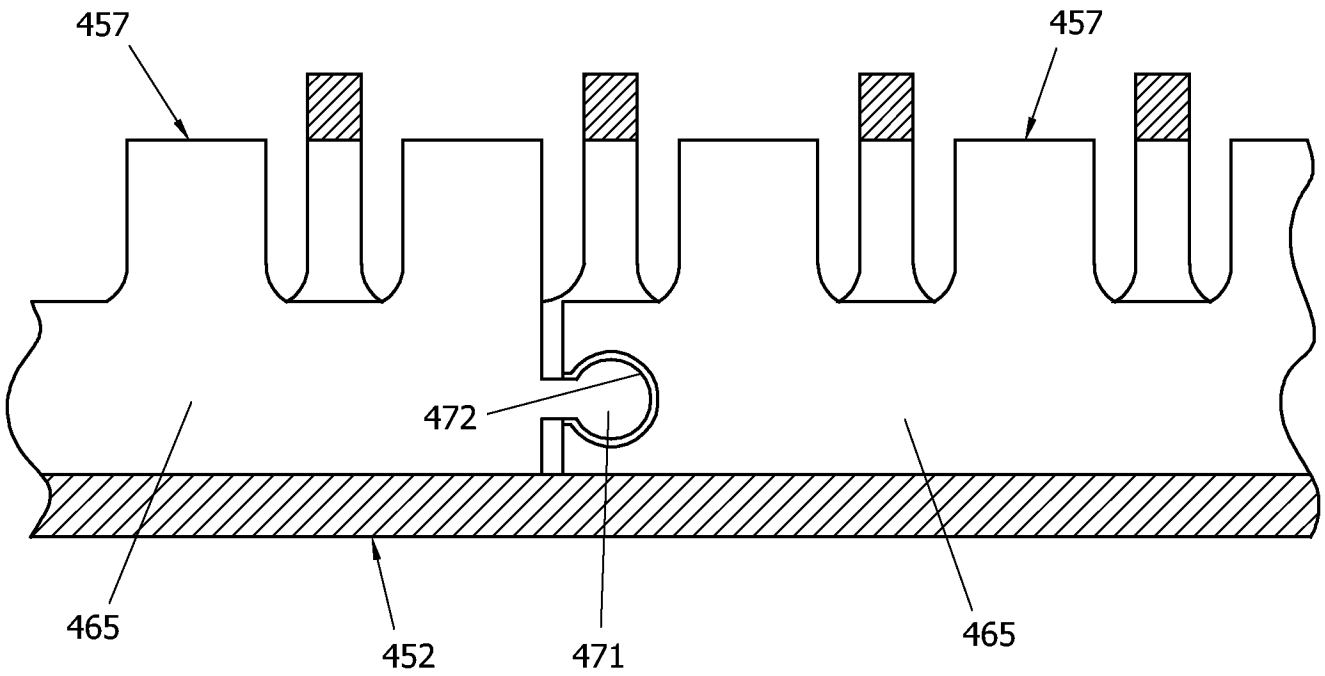
FIG. 13 is an enlarged cross-sectional view along a plane in longitudinal direction of the cutter members of portions of stationary and movable cutter members of yet another example of a device according to the invention.

As is shown in FIG. 13, all or some of the plurality of movable cutter members 457 may have its carrier 465 linked to the carrier 465 or carriers of one or more neighbouring movable cutter members 457 to form one or more cutter member chains that are drivable in a simple manner by driving only one or a few of the cutter members, the other cutter members being entrained by the driven cutter members to which they are linked. According to the present example, the carriers 465 are linked by interlocking coupling members 471, 472 that allow a slight pivotal movement of successive linked carriers relative to each other. During assembly, the mutually engaged coupling members 471, 472 are slided into engagement. Once arranged in the chamber, mutual movement in lateral direction that would allow the coupling members 471, 472 to disengage is prevented by the internal surfaces of the chamber into which the movable cutting members 457 fit with a close, free fit.

Because two or more carriers 457 are arranged in succession in longitudinal direction in the same chamber of a stationary cutter 452, the individual carriers 465 may be relatively short, which further facilitates accommodation of the cutter members 457 to deviations from the nominal shape, such as deviations within a tolerance range, of the chamber.

The movable cutter member 7 preferably has a largest cross-sectional size smaller than 10 mm and more preferably a largest cross-sectional size smaller than 5 mm or a largest cross-sectional size of 3 mm or less. By providing that the movable cutter member 7 and the hole 4 have small diameters, tight tolerances of the clearance between the movable cutter member 7 and the inner surfaces 5 of the hole can be insured more easily. For instance to ensure that the clearance is between 10 and 40 μm, for a hole 4 and a movable cutter member 7 having a nominal diameter of 3 mm, the movable cutter member 7 could for instance be worked to ISO tolerance H8 and the hole could for example be worked to ISO tolerance f7. To achieve the same tolerance range on the clearance for a hole 4 and a movable cutter member 7 having a nominal diameter of 6 mm, the movable cutter member 7 would for instance have to be worked to ISO tolerances H7 and, respectively, f6 (if the same classes are used with respect to the offset from the nominal size). This is one tolerance class higher, which requires more precise manufacturing and therefore entails additional costs.

Moreover, with the cross-sectional size of the movable cutter member 7 and of the hole 4, the bending stiffness of the movable cutter member 7 and of the hole 4 increases, causing increased friction if the cutter member 7 and/or the hole 4 are not straight. Another advantage of a small cross-sectional size of the movable cutter member 7 and of the hole 4 is, that the wall portion of the stationary cutter member between successive hair catching openings 6 may be very slender, so that the open hair-catching area may be very large in relation to the total shaving surface and the wall thickness between the shaving surface 3 and the inner surface 5 in the hole 4 may be very thin, which in turn is advantageous for achieving a close shave.

For reliable cutting of hairs of all sorts, the movable cutting member 7 preferably fits in the hole 4 with a clearance smaller than 50 μm and more preferably at most about 30 or 40 μm.

For ease of manufacturing, it is furthermore advantageous if the hole 4 has a circular cross-section, this facilitates working the hole 4 and the movable cutter member 7 to be fitted therein to corresponding sizes and shapes, with tight tolerances. However, instead of the profile of the hole having a circular cross-section, the profile may also have another shape, such as elliptical, square or triangular, the cutter members being shaped accordingly.

Figure 4:
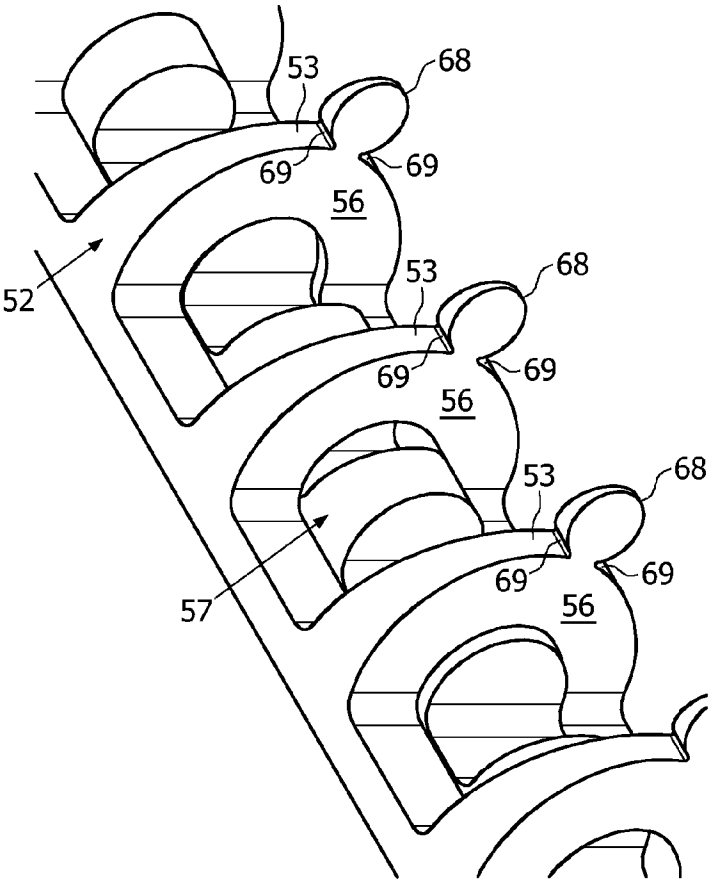
FIG. 4 is an enlarged perspective view of portions of the stationary and movable cutter members of another example of a hair-clipping device according to the invention.

In FIG. 4, portions of a stationary cutting member 52 and a movable cutting member 57 of another example of a hair-clipping device according to the invention are shown. The stationary cutting member 52 is provided with a row of ears 68 radially projecting from the shaving surface 53. Transitions 69 from the shaving surface 53 to the ears 68 are curved with a center of curvature on the outside of the shaving surface 53. Thus, the hair-catching ears 68 are particularly effective for stretching the skin, when the ears 68 are passed over the skin preceding the shaving surface, because the skin is freely tensioned in an area between the ears 68 and the shaving surface 53, where the stationary cutter member 52 does not contact the skin and therefore exerts no frictional force onto the skin in the direction of movement of the ears 68. To at least some extent, this effect may also be achieved if the transitions from the shaving surface to the ears are straight. The straight transitions are preferably flat to obtain evenly distributed contact pressure, but also another shape may be provided.

According to the present example, in circumferential sense, the ears 68 are disposed at least partially within the angular range occupied by the hair-catching openings 56 and preferably about 15-19° off-center in circumferential sense with respect to the hair-catching openings 56. This allows to use the ears 68, firstly, as skin stretchers if the hair-clipping device is passed over the skin with the ears 68 leading the portion of the shaving surface 53 that are in contact with the skin and, secondly, as spacers for keeping the movable cutter 57 further spaced from the skin if the hair-clipping device is passed over the skin with the ears 68 pointing to the skin approximately perpendicularly to the skin.

Figure 5:
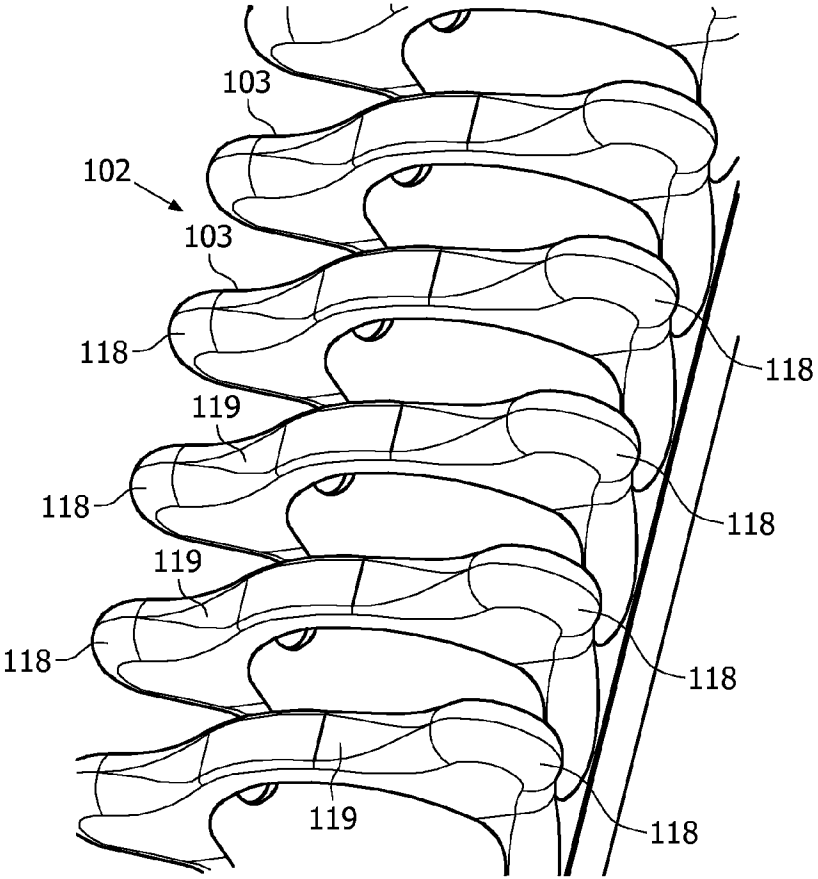
FIG. 5 is an enlarged perspective view of portions of the stationary and movable cutter members of yet another example of a hair-clipping device according to the invention.

In FIG. 5, portions of a stationary cutting member 102 of yet another example of a hair-clipping device according to the invention is shown. In this stationary cutting member 102, two rows of ears 118 project radially from the shaving surface 103 on opposite sides of a central portion of the shaving surface 103. Transitions 119 from the shaving surface 103 to the ears 118 are also curved with a center of curvature on the outside of the shaving surface 103. The two rows of ears allow the skin stretching effect to be achieved during passage of the stationary cutting member 102 over the skin in two opposite general directions.

Figure 6:
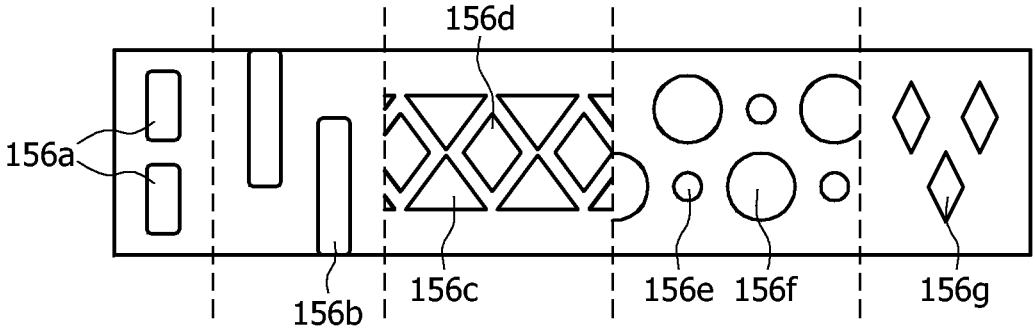
FIG. 6 is an enlarged top plan view of a number of alternative elaborations of the stationary cutter members of a hair-clipping device according to the invention.
Figure 7:
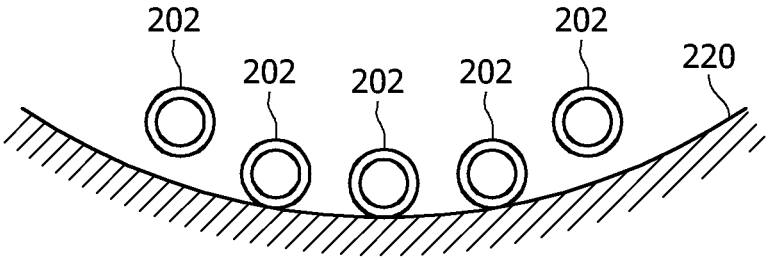
FIG. 7 is an enlarged side view of a configuration of cutter assemblies of a shaver according to the present invention.
Figure 8:
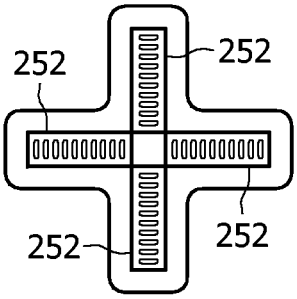
FIGS. 8 and 9 are top plan views of two further examples of configurations of cutter assemblies of a shaver according to the present invention.

Depending on the envisaged use of the hair-clipping device, the hair-catching openings 156 can be provided in many forms and patterns as is illustrated by the hair-catching openings 156*a*-156*g* in the alternative examples of sections of a stationary cutter 152 shown in FIG. 6.

Figure 9:
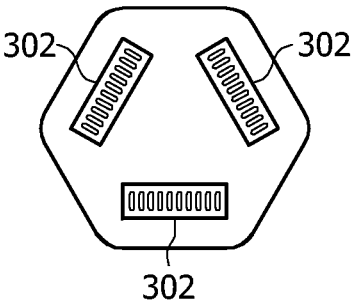
Figure 10:
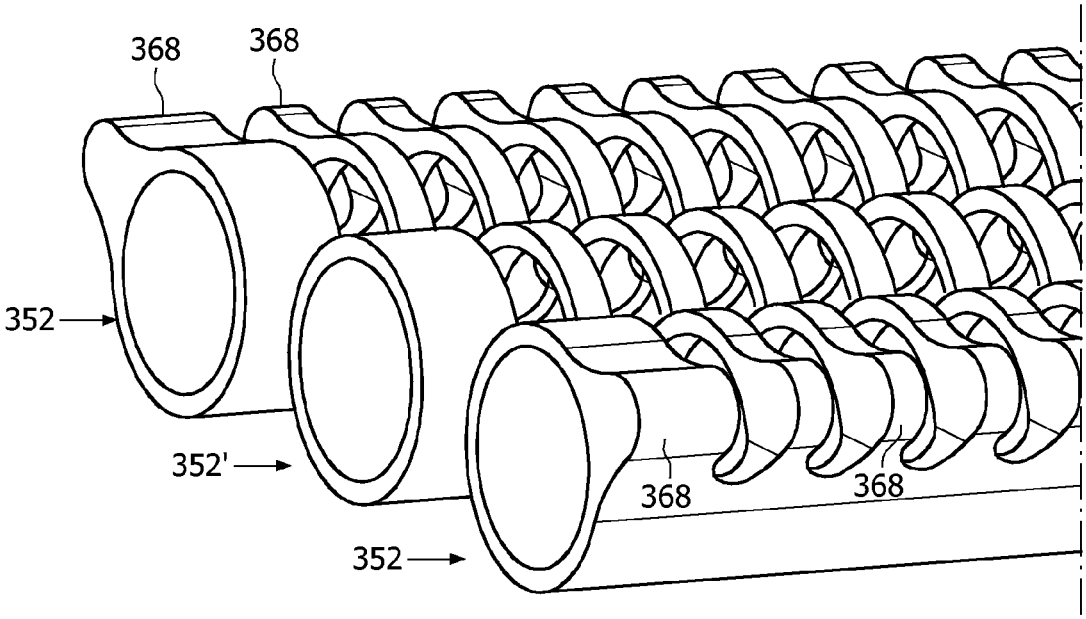
FIGS. 10 and 11 are enlarged perspective views of other examples of a configuration of cutter assemblies of a shaver according to the present invention.

As is illustrated by FIGS. 7-10, a hair-clipping device according to the invention may also be equipped with more than one set of stationary and movable cutter members. In the example shown in FIG. 7, a plurality of stationary cutter members 202 is arranged side by side in an arrangement defining a curved plane. Such an arrangement is advantageous for effectively shaving concave skin areas 220. In the example shown in FIG. 8, four stationary cutters 252 are arranged two-by-two in-line along crossing lines. Such an arrangement allows shaving a skin portion quickly by moving over the skin portions in various directions without having to rotate the hair-clipping device accordingly. Similar advantages are achieved with another embodiment as shown in FIG. 9 in which the stationary cutter members 302 are oriented in different directions, according to this example along lines forming sides of a equilateral triangle. In FIG. 10 an arrangement of stationary cutter members 352, 352' is shown, of which only outer ones are provided with hair-catching and skin-stretching ears 368. In such an arrangement, the number of stationary cutting members is larger than the number of rows of ears, so that apart from the cutting members adapted for catching longer hairs and stretching the skin, also cutting members dedicated for close shaving are provided.

Figure 11:
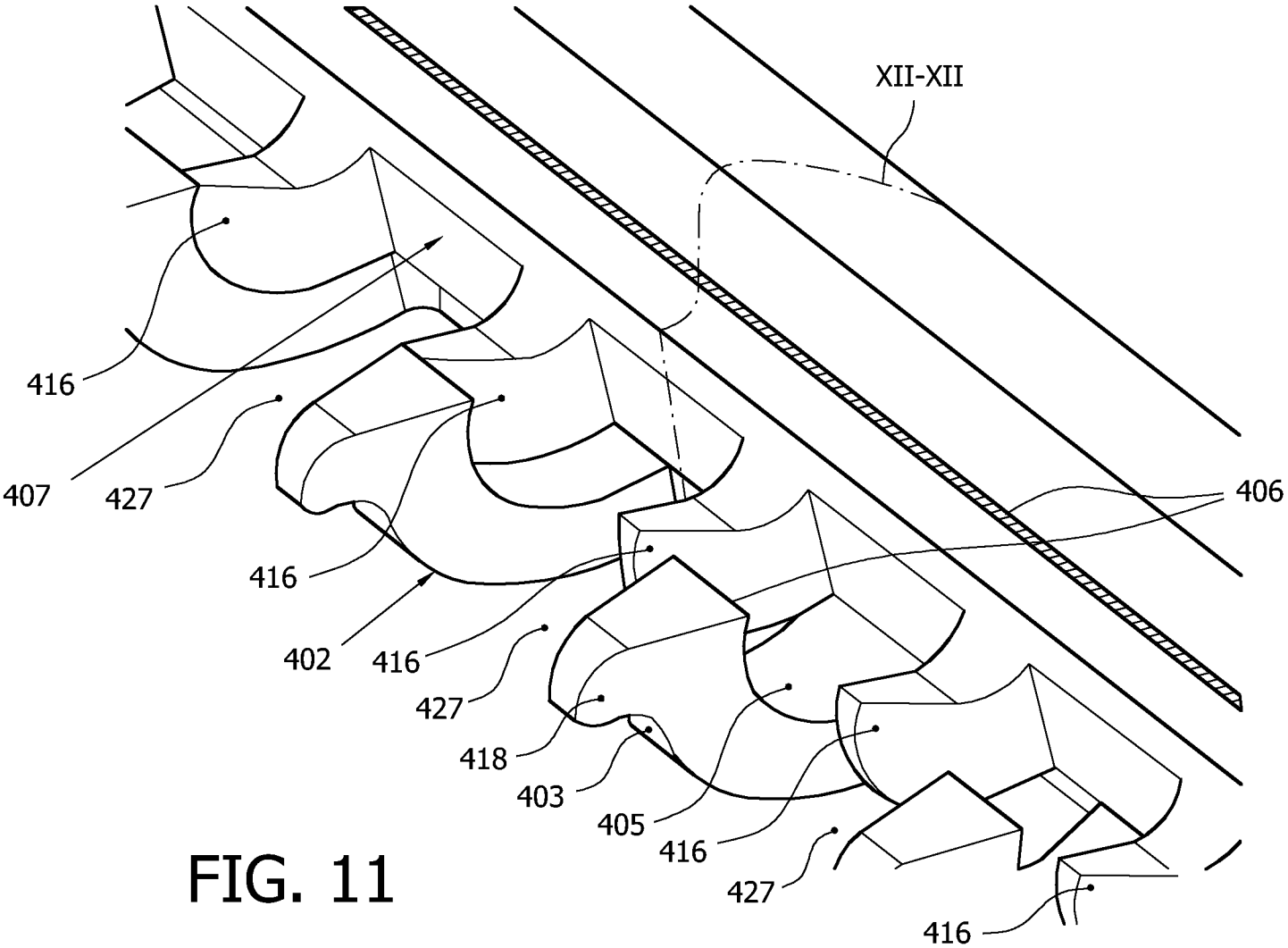
Figure 12:
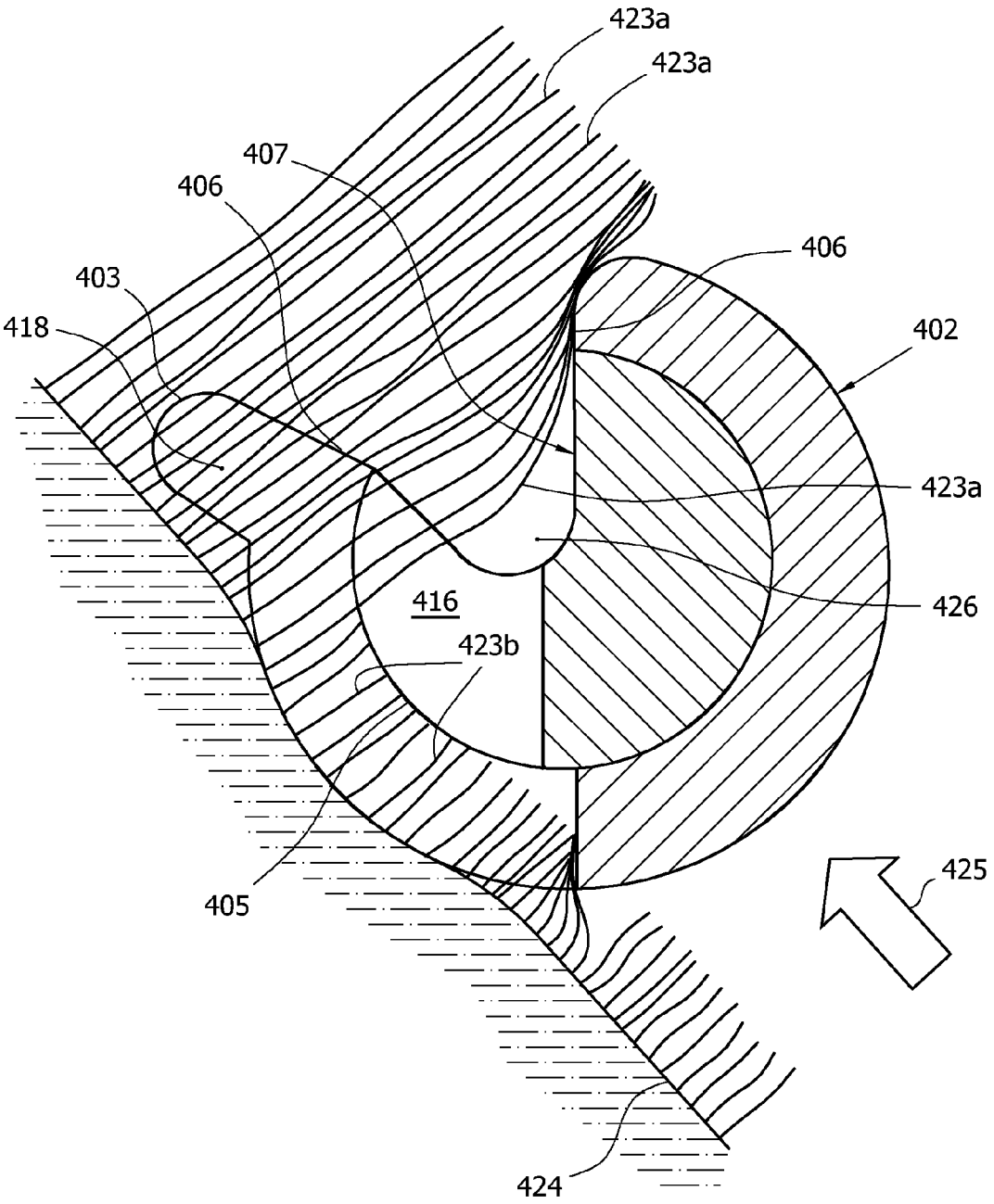
FIG. 12 is a cross-sectional view of the cutter shown in FIG. 11 while in operation.

As is illustrated by FIGS. 11 and 12, a hair-clipping device according to the invention may also have a hair-catching opening 406 that has a length in longitudinal direction of the cutter members 402, 407 that covers a plurality of the cutters 416. Such hair-catching opening designs are particularly suitable for efficiently trimming long hairs 423*a* to hairs 423*b* having shorter remaining length measured from the skin 424 (only some of the hairs are designated by reference numerals), with little risk of the hair-clipping device becoming stuck due to excessive amounts of hair being caught between the cutting members. In use the hair-clipping device is moved in the direction indicated by arrow 425 while in contact with the skin 424 with the ears 403 leading and close to or in contact with the skin 424.

As is shown in FIG. 12, in the area of where the opening covers a plurality of cutters 416, shearing action for cutting the hairs is absent over a section of the circumference of the movable cutter member 407. This allows at least most of the longer hairs 423*a* to easily reach a segment of the circumference of the movable cutter member 407 where the shearing action between the stationary cutter member 402 and the movable cutter member 407 causes the hairs to be cut and allows most of the long hairs 423*a* to be cut only once, which reduces the resistance encountered by the movable cutter member 407 during quick trimming. To further facilitate the entry of long hairs, the circumference of the cutters 416 include recesses 426 forming a continuous, open area with the opening 406.

To reduce the length of the sections of the cutter members where entry of long hairs between the cutting edges is impaired, the number of hair-catching openings is preferably small. According to the present example, a single hair-catching opening 406 extends from the outer surface 403 to the inner surface 405.

To further reduce the length of the sections of the cutter members where entry of long hairs between the cutting edges is impaired, the hair-catching opening 406 of the stationary cutter member 402 or of at least one of the stationary cutter members 407 preferably covers substantially the whole length of that stationary cutter member 402 (preferably at least about 80% and more preferably at least about 90% of the length).

A particularly effective design for trimming the hair 423*a* is obtained if, as in the present example, the hair-catching opening 406 of the stationary cutter member 402 is in the form of a slit extending in the longitudinal direction of the movable cutter member 402 and has a plurality of bays 427 projecting circumferentially from the slit, the cutting edges of the stationary cutter member 402 extending along said bays 427.

From the foregoing, it will be clear to the skilled person, that within the framework of invention as set forth in the claims also many variations other than the examples described above are conceivable. For instance, the hair catching openings need not open in a direction perpendicular to a plane defined by a number of side-by-side arranged stationary cutter members, but may also open in a direction more or less parallel to such a plane for effectively catching long hair. The hole in the stationary cutter member need not be straight, but may also be curved if the movable cutter member or cutter members in the hole is resp. are also curved and/or sufficiently flexible. Also, the movement of the movable cutter member in the stationary cutter member need not be reciprocating in longitudinal direction, but may also be or include a rotary movement, for instance about a center line of the hole in which the movable cutter member is fitted.

The invention claimed is:

1. A hair-clipping device comprising:

a stationary cutter member having outer and inner surfaces, a chamber bounded by the inner surface, a plurality of alternating skin-stretching portions and hair-catching openings extending from the outer surface to the inner surface;

a movable cutter member comprising a carrier oriented in a longitudinal direction and a plurality of alternating recesses and cutters projecting radially from the carrier and each having a cutting edge, the movable cutter member is positioned in the chamber with a free, close fit; and a drive coupled to the movable cutter member for driving the movable cutter member relative to the stationary cutter member, wherein the carrier and the cutters are solid and the movable cutter member has a cross-sectional size of 3 mm or less.

2. The hair-clipping device according to claim 1, wherein the cutting edges are formed integrally with the carrier by the edges of the recesses.

3. The hair-clipping device according to claim 1, wherein the chamber has a circular cross-section.

4. The hair-clipping device according to claim 1, wherein the movable cutting member fits in the chamber with a clearance smaller than 50 μm.

5. The hair-clipping device according to claim 1, wherein each of the plurality of the skin-stretching portions comprises at least one ear radially projecting from the outer surface, transitions from the outer surface to the ears being curved with a center of curvature on the outside of the outer surface, the ears of the plurality of the skin-stretching portions forming a row.

6. The hair-clipping device according to claim 5, comprising at least two stationary cutter members and corresponding movable cutter members arranged adjacent to each other, each of the plurality of the skin-stretching portions of at least one stationary cutter member comprising at least one ear radially projecting from the outer surface, the ears of the plurality of the skin-stretching portions forming a row extending along at least one of the stationary cutter members, the number of stationary cutter members is larger than the number of rows of ears.

7. The hair-clipping device according to claim 1, wherein each of the plurality of the skin-stretching portions includes an ear radially projecting from the outer surface, the plurality of ears forming a row extending along the stationary cutter member, the ears of said row being located at least partially within an angular range parallel to space occupied by the at least one hair-catching opening.

8. The hair-clipping device according to claim 1, further comprising at least two movable cutter members arranged in succession in the longitudinal direction.

9. The hair-clipping device according to claim 8, wherein the carrier of each of said at least two movable cutter members are longitudinally linked together for transferring longitudinal movement of one of said at least two movable cutter members to another of said at least two movable cutter members.

10. The hair clipping device according to claim 1, wherein each of the hair-catching openings has a length in the longitudinal direction that is at least sufficient to extend in the longitudinal direction across at least two cutters of the plurality of the cutters.

11. The hair clipping device according to claim 10, wherein a combined longitudinal length of each of the plurality of the hair-catching openings of the stationary cutter member is at least sufficient to extend in the longitudinal direction across at least 80% of a longitudinal length of the stationary cutter member.

12. The hair clipping device according to claim 11, wherein each of the plurality of hair-catching openings is in the form of a slit extending across the longitudinal direction and having a plurality of bays projecting circumferentially from the slit, the cutting edges of the stationary cutter member or of at least one of the stationary cutter member extending along said bays.

13. A cutter-member assembly for a hair-clipping device comprising:

a stationary cutter member having outer and inner surfaces, a chamber bounded by the inner surface, and a plurality of alternating skin-stretching portions and hair-catching openings extending from the outer surface to the inner surface; and a movable cutter member comprising a carrier oriented in a longitudinal direction and a plurality of alternating recesses and cutters projecting radially from the carrier each having at least one cutting edge, the movable cutter member is positioned in the chamber with a free, close fit, wherein the carrier and the cutters are solid and the movable cutter member has a cross-sectional size of 3 mm or less.

* * * * *